United States Patent [19]

Winey

[11] 4,210,786

[45] Jul. 1, 1980

[54] MAGNETIC FIELD STRUCTURE FOR PLANAR SPEAKER

[75] Inventor: James M. Winey, White Bear Lake, Minn.

[73] Assignee: Magnepan, Incorporated, White Bear Lake, Minn.

[21] Appl. No.: 6,007

[22] Filed: Jan. 24, 1979

[51] Int. Cl.² ..... H04R 9/06

[52] U.S. Cl. ..... 179/115.5 PV; 179/119 R

[58] Field of Search ..... 179/115.5 PV, 117, 119 R

[56] References Cited

U.S. PATENT DOCUMENTS

| | | | |
|---|---|---|---|
| 3,013,905 | 12/1961 | Gamzon et al. | 179/115.5 PV |
| 3,674,946 | 7/1972 | Winey | 179/115.5 PV |
| 3,873,784 | 3/1975 | Doschek | 179/115.5 PV |
| 3,919,499 | 11/1975 | Winey | 179/115.5 PV |

FOREIGN PATENT DOCUMENTS

| | | | |
|---|---|---|---|
| 1,259,948 | 2/1968 | Fed. Rep. of Germany | 179/115.5 PV |

*Primary Examiner*—James W. Moffitt

*Attorney, Agent, or Firm*—H. Dale Palmatier

[57] ABSTRACT

An acoustical electromagnetic transducer as a loudspeaker and having a vibrating diaphragm with signal current carrying wires on the face thereof; a magnetic structure confronting the diaphragm in spaced relation and having a magnetic sheet metal plate and a plurality of permanent magnet strips on the panel and spaced from each other and along the runs of the conductor on the diaphragm, the permanent magnet strips being formed of a different magnetic material with a significantly different magnetic characteristic than the strips adjacent thereto.

10 Claims, 7 Drawing Figures

FIG. 1
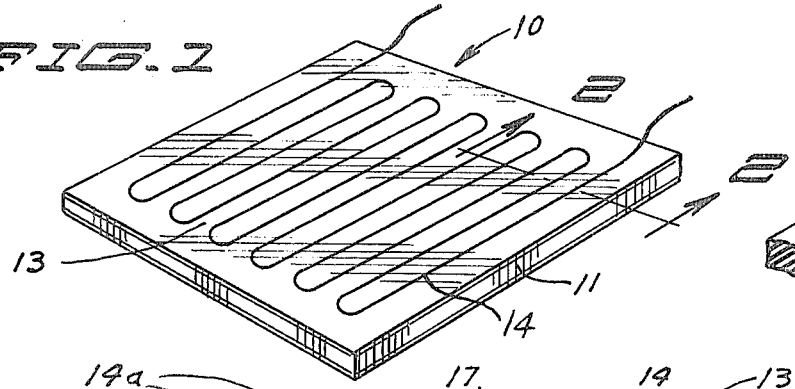
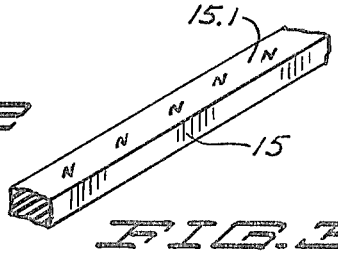
FIG. 3
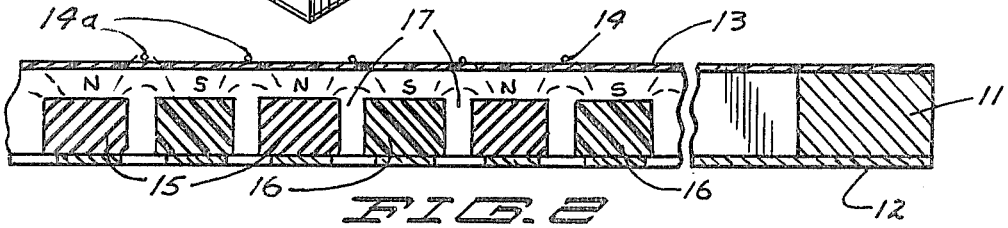
FIG. 2
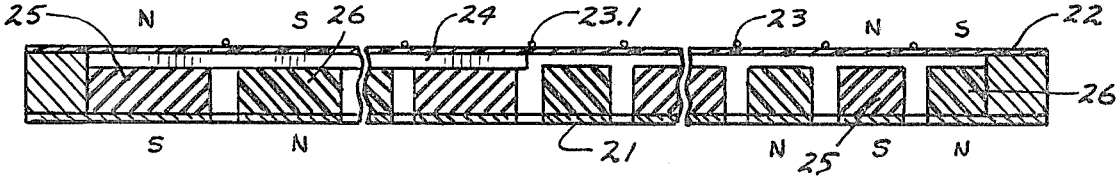
FIG. 5
FIG. 4
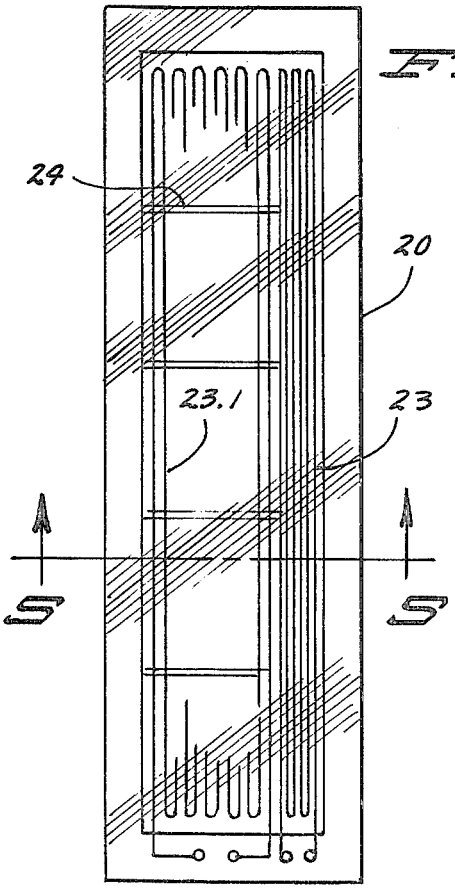
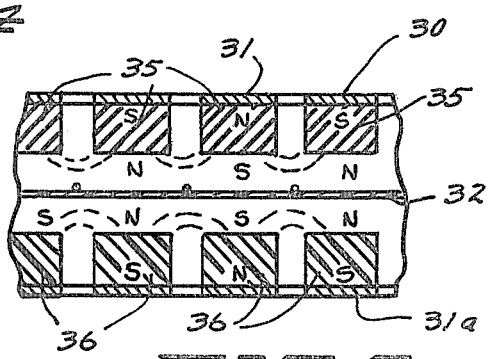
FIG. 6
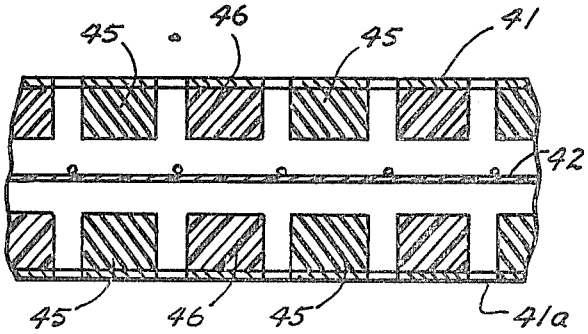
FIG. 7

MAGNETIC FIELD STRUCTURE FOR PLANAR SPEAKER

This invention relates to acoustical electromagnetic transducers of the type incorporating a vibrating diaphragm and more particularly relates to such a transducer to be operated as a loudspeaker.

BACKGROUND OF THE INVENTION

Electromagnetic loudspeakers utilizing a vibrating diaphragm as a sound generator have existed previously in various forms. Although the magnetic structures of such speakers have varied considerably, numerous problems have been encountered.

In Gamzon, U.S. Pat. No. 3,013,905, the magnetic structure includes ceramic magnets which are of considerable size and cannot be materially reduced in size. As a result, the magnetic zones must be widely spaced from one another and the conductors on the diaphragm must also be identically spaced from each other. As a result, the driving forces applied to the diaphragm cannot be maximized.

In the Winey U.S. Pat. No. 3,674,946, the permanent magnet is of a rubber bonded barium ferrite composite material wherein the ferrite particles are mechanically oriented during processing and bonded in the rubber or plastic matrix or binder to hold them in place. The specific magnetic material is known by its trademark PLASTIFORM, sold by 3M Company of Saint Paul, Minn. This magnetic material is formed in sheets which may be apertured so that the magnetic material is acoustically transparent, the material may also be cut in strips as disclosed in the patent and as subsequently illustrated in a later U.S. Pat. No. 3,919,499. Such PLASTIFORM material and other flexible magnetic material such as that made under the trademark KOROSEAL by B. F. Goodrich Company, Akron, Ohio, do not have sufficient coercive force as may be desired in such speakers under some circumstances.

Another U.S. Pat. No. 3,873,784, Doschek, discloses a transducer with a diaphragm and utilizing a permanent magnet of an alloy of iron, nickel, aluminum or cobalt, and preferably a sintered ferrite material. Such sintered material is extremely difficult to work with and cannot easily be used in small pieces, thereby encountering the same problems as in Gamzon patent above.

Recently, magnets with extremely high coercive force have been produced in sizes that may be suitable for use in the magnetic structures of diaphragm type loudspeakers. Such magnets include polymer molded samarium cobalt magnets. Such samarium cobalt magnets are also sintered instead of being carried in a polymer binder. Such new materials have a much higher coercive force and magnetic flux density than previously available materials, but such new materials are extremely expensive, especially for use in diaphragm type speakers wherein broad areas of diaphragm must be accommodated.

SUMMARY OF THE INVENTION

The present invention provides the diaphragm speaker with a magnetic structure which maximizes magnetic flux density in the gap between the magnets and diaphragm and at the same time minimizes the cost of the magnetic field structure.

The magnetic structure of the transducer utilizes a plurality of magnets in strips. The strips adjacent to each other are of different magnetic material and different flux density. For instance, one magnetic strip may be of rubber bonded barium ferrite composite material which has a rated flux density of 1200 gauss and coercive force of 1480 oersteds; and the adjacent magnetic strips may be of an entirely different magnetic material such as samarium cobalt in a polymer binder with a rated flux density of about 5500 gauss and a coercive force of 7500 oersteds. On the alternative one set of magnetic strips may be of barium ferrite in a ceramic magnet which has a flux density and coercive force somewhat greater than the rubber bonded material, and the adjacent strips may be formed of sintered samarium cobalt which has more coercive force, 16000 oersteds, and greater flux density, 8000 gauss, than the samarium cobalt in the polymer binder..

In a speaker or transducer, the magnetic strips are on a magnetic backing panel of iron plate or sheet metal; and each of the magnetic strips of one material is adjacent a magnetic strip of a different magnetic material. Preferably the strips of different material are alternated, first one material, and then the other material. The effect of alternating the strip magnets of different materials is to significantly increase the flux density in the gaps between the magnets and diaphragm; and to increase the magnitude of diaphragm movement and volume of sound generated, without disproportionately increasing the cost of the magnetic structure.

In suitable magnetic structures, alternating types of magnetic material in adjacent strips, the flux density measured in the gaps was somewhat less than rated flux density, but still a striking improvement.

Using PLASTIFORM (rubber bonded barium ferrite), ceramic magnet with barium ferrite, and samarium cobalt in a polymer binding in different arrangements, the flux densities were measured as follows:

| | |
|---|---|
| ALL PLASTIFORM | 900 gauss |
| All Ceramic | 1300 gauss |
| All Samarium Cobalt | 2000 gauss |
| ½ PLASTIFORM, ½ Ceramic | 1100 gauss |
| ½ PLASTIFORM, ½ Samarium Cobalt | 1300 gauss |
| ½ Ceramic, ½ Samarium Cobalt | 1500 gauss |

In spaced and confronting magnetic structures with the diaphragm sandwiched between them, the different types of magnets may be arranged adjacent each other on the same side of the diaphragm, or adjacent each other on opposite sides of the diaphragm with magnets of like material being grouped together on one side of the diaphragm.

BRIEF DESCRIPTION OF THE DRAWINGS

FIG. 1 is a perspective view of a transducer or speaker according to the present invention;

FIG. 2 is an enlarged detail section view taken approximately at 2—2 in FIG. 1;

FIG. 3 is an enlarged perspective view of a length of the strip magnet;

FIG. 4 is an elevation view of a modified form of transducer incorporating the invention;

FIG. 5 is an enlarged detail section view, taken approximately at 5—5 in FIG. 4 and having portions thereof broken away for clarity of detail;

FIG. 6 is an enlarged detail section view of a modified form of the invention;

FIG. 7 is an enlarged detail section view of still another modified form of the invention.

DETAILED SPECIFICATION

In the form of the invention shown in FIGS. 1–3, the transducer is indicated in general by the numeral 10 and includes a substantially rigid frame 11 sandwiched between a perforate and acoustically transparent sheet metal panel 12 made of galvanized iron, and a taut film type diaphragm 13 which may be made of any of a number of plastic films such as a film known by its trademark MYLAR and sold by 3M Company of Saint Paul, Minn. The diaphragm 13 and the panel 12 are both secured to the frame 11 to allow the diaphragm to vibrate while the panel stays stationary and to prevent any relative movement of the diaphragm with respect to the panel in a direction parallel to the plane of the diaphragm.

The diaphragm 13 carries a conductor 14 thereon arranged in a plurality of elongate and spaced apart conductor runs **14*a* to which sound generating current from an audio amplifier system may be applied. The conductor 14 may be formed in various ways on the diaphragm 13, but may simply be a wire as illustrated adhesively secured to the face of the diaphragm. Otherwise, the wire or conductor 14** may be formed by a printed circuit on the face of the diaphragm.

The sheet metal panel 12 is a part of the magnetic structure which also includes a plurality of magnetic strips 15 and 16 which are applied onto the surface of the panel 12. The magnetic strips 15 and 16 are magnetized in a direction through their thinnest dimension so that all of the upper surface of each of the magnets has one polarity, as is indicated in FIG. 3, the upper surface being designated by the numeral 15.1. The bottom surface of the strips 15 and 16 are of opposite polarity. The strips 15 and 16 are arranged in parallel and spaced relation to each other so as to define gaps 17 therebetween across which magnetic fields are established by the magnets. The gaps 17 are disposed immediately beneath the runs **14*a*** of the conductor so that the conductor runs are under the influence of these magnetic fields.

Each of the magnetic strips 15 and 16 comprises a permanent magnet and is formed of a magnetic material which is different than the magnetic material in the adjacent strips. For instance, the magnetic strips 15 may be formed of PLASTIFORM, a rubber bonded barium ferrite composite material wherein the ferrite materials are mechanically oriented during processing and are bonded in the rubber or plastic matrix or binder to hold them in place. Relatively speaking, the coercive force of the PLASTIFORM material is relatively weak or of low magnitude.

Alternate magnet strips 16 are formed of a different magnetic material such as samarium cobalt in a polymer binder, which is considerably more expensive than the PLASTIFORM in strips 15, but which is also significantly different in its magnetic characteristics than PLASTIFORM, and is generally regarded as producing a substantially greater coercive force than the PLASTIFORM in the alternate strips. The material in one set of alternate strips may also be sintered samarium cobalt, or one set of the strips may be ceramic magnets. In any event, it has been considered significant to the present invention that alternate strips of the magnetic material in the magnetic structure are formed of different magnetic materials.

This use of the alternating magnetic strips of different materials is particularly useful in producing the transducers 10 used as tweeter or midrange speakers. FIGS. 4 and 5 illustrate a modified form of the invention wherein the transducer 20 has a magnetic metallic back panel 21 and a diaphragm 22 thereon with current-carrying conductors 23 and 23.1. The conductors 23 are spaced quite close together in the tweeter section of the transducer, and the other runs 23.1 of the conductor are rather widely spaced in the midrange or base section of the speaker. The diaphragm is restrained against vibrating at certain areas by ribs 24 so as to divide the diaphragm into various areas which may resonate at different audio frequencies. The magnet strips 25 and 26 are again arranged along the runs of the wires on the diaphragm, producing gaps between the magnets. The several adjacent magnets 25 and 26 are of different magnetic materials as previously described in connection with FIGS. 1–3.

In the form illustrated in FIG. 5, the transducer is indicated in general by numeral 30 and has a magnetic structure including two separate back panels 31 and **31*a*. A diaphragm 32 is located between the two magnetic structures. In this case, all of the magnet strips 35 on the top panel 31 are formed of one nature of magnetic material such as PLASTIFORM or barium ferrite-containing material, and all of the adjacent magnetic strips 36 at the other side of the diaphragm and on the panel 31*a*** are formed of another magnetic material with significantly different magnetic characteristics.

In the form of the invention illustrated in FIG. 6, again, the diaphragm 42 is sandwiched between the two magnetic structures, the upper one including a backing plate 41 and the lower structure including a backing plate **41*a*. In this form, the magnetic strips on the upper panel are of alternate types of material and are designated by the numerals 45 and 46. Similarly, the strips 45 and 46 on the lower panel 41*a*** also alternate in types of material and therefore in magnetic characteristics.

It will therefore be seen that diaphragm type speakers may be formed with magnetic strips of varying types of magnetic material with different magnetic characteristics in order to produce a greater magnetic field in the area of the conductors on the diaphragm. This type of speaker utilizing magnetic strips of alternating types of material produces a greater output without increasing the signal current input to the speaker and produces higher transient response in the transducer.

What is claimed is:

1. An acoustical electromagnetic transducer, comprising a film type diaphragm having conductor means on the surface thereof and arranged in a plurality of elongate and spaced conductor runs through which a sound generating current is to be carried, and a magnetic structure confronting the diaphragm in spaced relation and having a plurality of elongate and spaced magnetic strips extending along each other and defining elongate magnetic gaps therebetween and extending along the conductor runs of the diaphragm, the magnetic strips being permanent magnets establishing magnetic flux in and adjacent the gaps, magnetic strips adjacent to each other being formed of different magnetic materials with significantly different magnetic properties.

2. The acoustical electromagnetic transducer according to claim 1 and all of the magnetic strips being disposed at one side of the diaphragm.

3. The acoustical electromagnetic transducer according to claim 1 and the magnetic structure having magnetic strips disposed at both sides of the diaphragm.

4. The acoustical electromagnetic transducer according to claim 3 wherein the magnetic strips at one side of the diaphragm include first and second magnetic strips adjacent each other and respectively formed of said different magnetic materials.

5. The acoustical electromagnetic transducer according to claim 3 wherein adjacent magnetic strips of said different magnetic material are respectively disposed at opposite sides of the diaphragm.

6. The acoustical electromagnetic transducer according to claim 3 and all of the magnetic strips at one side of the diaphragm are of one of said magnetic materials, and all of the magnetic strips at the other side of the diaphragm are of another of said magnetic materials.

7. The acoustical electromagnetic transducer according to claim 1 wherein certain of the magnetic strips contain samarium cobalt.

8. The acoustical electromagnetic transducer according to claim 7 wherein certain of the magnetic strips contain barium ferrite.

9. The acoustical electromagnetic transducer according to claim 8 wherein the magnetic strips containing barium ferrite are a plastic or rubber bonded barium ferrite material.

10. An acoustical electromagnetic transducer comprising a substantially planar diaphragm of film type material and having conductor means on the surface thereof and arranged in a plurality of elongate and spaced conductor runs through which a sound generating current is to be carried, and a magnetic structure confronting the diaphragm in spaced relation and having means connected with the diaphragm and preventing relative movement between the magnetic structure and diaphragm in a direction generally along the diaphragm, the magnetic structure having a plurality of elongate and spaced magnetic strips extending along each other and defining elongate magnetic gaps therebetween and extending along the conductor runs of the diaphragm, the magnetic strips being permanent magnets establishing magnetic flux in and adjacent the gaps, the magnetic strips being disposed at one side of the diaphragm, the magnetic structure including an acoustically transparent panel of iron against which the magnetic strips lie, said magnetic strips adjacent to each other being formed of different magnetic materials with significantly different magnetic properties, certain of the magnetic strips containing samarium cobalt, and other of the magnetic strips containing barium ferrite, the samarium cobalt-containing strips producing a coercive force significantly greater than the coercive force produced by the barium ferrite-containing material.

* * * * *